US005189405A

United States Patent [19]

Yamashita et al.

[11] Patent Number: 5,189,405

[45] Date of Patent: Feb. 23, 1993

[54] THIN FILM ELECTROLUMINESCENT PANEL

[75] Inventors: Takuo Yamashita; Takashi Ogura; Hiroaki Nakaya; Masaru Yoshida, all of Nara, Japan

[73] Assignee: Sharp Kabushiki Kaisha, Osaka, Japan

[21] Appl. No.: 811,905

[22] Filed: Dec. 23, 1991

Related U.S. Application Data

[63] Continuation of Ser. No. 470,154, Jan. 25, 1990, abandoned.

[30] Foreign Application Priority Data

Jan. 26, 1989 [JP] Japan ..... 1-17085

[51] Int. Cl.[5] ..... G09G 3/30

[52] U.S. Cl. ..... 340/781; 313/509; 313/512

[58] Field of Search ..... 313/506, 509, 592; 428/690; 340/784, 781; 359/52, 62, 74, 75

[56] References Cited

U.S. PATENT DOCUMENTS 3,509,401 8/1967 Calley ..... 313/512
4,357,557 11/1982 Inohara ..... 313/509
4,767,679 8/1989 Kawachi ..... 313/503
4,967,117 10/1990 Yoshioka ..... 313/512

FOREIGN PATENT DOCUMENTS 3531736 3/1966 Fed. Rep. of Germany ..... 350/345
44-17303 7/1969 Japan .
60-41437 9/1985 Japan .
61-290693 12/1986 Japan .

*Primary Examiner*—Ulysses Weldon
*Assistant Examiner*—Mathew Luu

[57] ABSTRACT

A thin film electroluminescent panel includes a transparent substrate with an electroluminescent element formed on the substrate. There is a moisture proof sheet to cover the electroluminescent element. The moisture proof sheet includes a metal layer laminated between the two resin films. The periphery of the moisture proof sheet is adhered to the transparent substrate. There is a moisture proof sheet with a moisture absorbent powder thereon, located between the electroluminescent element and the moisture proof sheet. The combination prevents moisture from affecting the operation of the electroluminescent element and provides for stability.

17 Claims, 2 Drawing Sheets

THIN FILM ELECTROLUMINESCENT PANEL

This application is a continuation of application Ser. No. 07/470,154 filed on Jan. 25, 1990, now abandoned.

BACKGROUND OF THE INVENTION

1. Field of the Invention

The present invention relates to a thin film electroluminescent panel which can be used for a display device in a personal computer, a word processor or the like.

2. Prior Art

A thin film electroluminescent (hereinafter referred to as EL) panel has an EL element formed on a glass substrate. The EL element should be protected from humidity in order to maintain its reliability.

In a prior art EL panel, an EL element formed on a glass substrate was covered by a backup glass, and the space between the EL element and the backup glass was filled with silicone oil containing silica gel powder and black insulator powder. The silicone oil was sealed hermetically.

In another prior art thin film EL panel, a laminate film was used to prevent the penetration of humidity into the EL element (for example, JP-A 61-290693).

However, in the described prior art thin film EL panel, the cost of silicone oil with silica gel powder and black insulator powder was high. Further, many steps and a long time were needed for manufacturing a thin film EL panel. For example, the space between the EL element and the backup glass had to be evacuated upon filling the silicone oil. Therefore, it was very difficult to lower the cost of the thin film EL panel. Further, the thickness and the weight of the backup glass itself set limits on making the thickness of the thin film EL panel thinner and making the weight of the panel lighter.

On the other hand, the latter prior art thin film panel did not take into account the moisture absorption function specifically in order to secure high reliability. Further, it did not intend to improve the contrast thereof.

SUMMARY OF THE INVENTION

It is an object of this invention to provide a thin film EL panel which is highly reliable in moistureproofing.

In order to achieve the object of the present invention, a thin film electroluminescent panel, according to the present invention, comprises a transparent substrate, a thin film electroluminescent element formed on the transparent substrate. There is a moisture-proof sheet to cover the thin film electroluminescent element, the periphery of the moisture-proof sheet being adhered to the transparent substrate also and a moisture absorption sheet of an organic polymer with scattered powder of moisture absorbent is used, the sheet being arranged between the thin film electroluminescent element and the moisture-proof sheet and being adhered planarly to the thin film electroluminescent element.

An advantage of the present invention in that the reliability of a thin film EL panel against moisture is improved to attain a longer life time for the panel.

BRIEF DESCRIPTION OF THE DRAWINGS

These and other objects and features of the present invention will become clearer from the following description taken in conjunction with the preferred embodiment thereof with reference to the accompanying drawings, in which.

DETAILED DESCRIPTION OF THE PREFERRED EMBODIMENT

Figure 1:
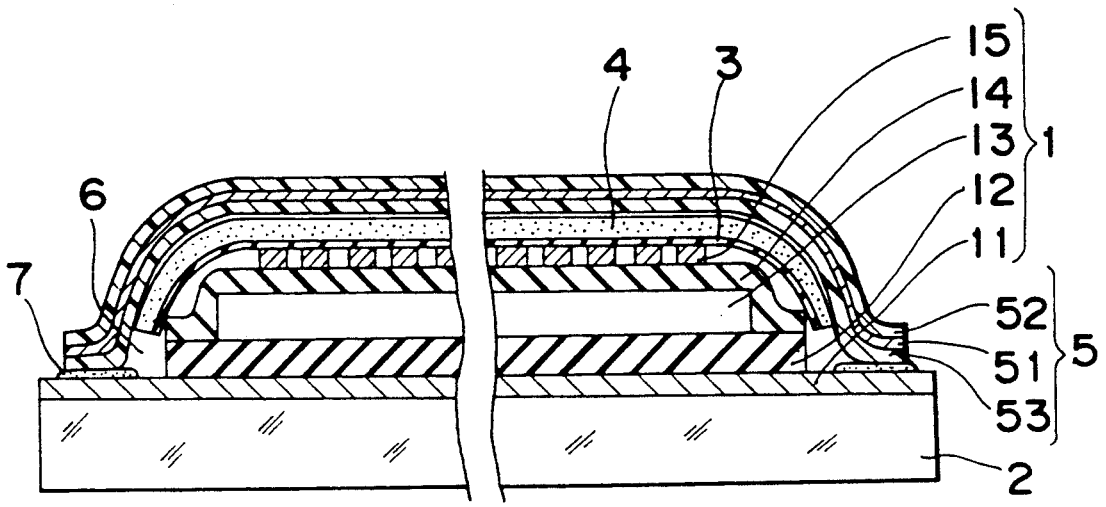
FIG. 1 is a schematic sectional view of an embodiment of this invention.

FIG. 1 is a schematic sectional view of an embodiment of this invention, wherein the reference numeral 1 denotes an EL element. The EL element 1 is manufactured by forming successively lower transparent stripe electrodes 11 arranged in parallel to each other with a constant distance, a lower insulating layer 12, an EL layer 13, an upper insulating layer 14 and upper stripe electrodes 15 arranged in parallel to each other with a constant distance in a direction perpendicular to the direction of the lower stripe electrodes 11 on a transparent substrate 2 made of a transparent material such as glass. One of the insulating layers 12 and 14 may be omitted. A plastic film 3 with heat-sealing property and a moisture absorption sheet 4 both having an area roughly equal to that of the EL element 1 are arranged on the EL element 1 successively. Then, a moisture-proof sheet 5 is arranged on the moisture absorption sheet 4. The moisture-proof sheet 5 has an area slightly larger than those of the plastic film 3 and the moisture absorption sheet 4 in order to cover the EL element 1 formed on the transparent substrate 2 and the periphery thereof forming a space 6 with the EL element 1 is adhered to the transparent substrate 2 using epoxy resin 7 to seal the EL element 1 hermetically.

Preferably, a moisture-proof sheet 5 is a layered sheet made of a metallic foil 51 of aluminum or the like of a thickness of 5–50 μm and two organic resin films 52 and 53 of polyester or the like of a thickness 5–50 μm interposing the metallic foil 51 inbetween to form a sandwich structure. Both organic resin films 52 and 53 may be made of the same material or of different materials to each other. The moisture-proof effect is mainly ascribed to the nonpermeability of moisture through the metallic foil 51. On the other hand, both organic resin films 52 and 53 serve mainly for the protection of the surfaces of the metallic film 51 and for the electric insulation of the EL element 1. However, needless to say, the outer film 53 and especially the inner film 52 is preferably made of a material of a higher nonpermeability of moisture.

In the manufacturing process of a thin film EL panel shown in FIG. 1, first an EL element 1 is formed on the transparent substrate 2 according to a known method. Then, after both a plastic film 3 and a moisture absorption sheet 4 are piled successively on the EL element 1, a moisture-proof sheet 5 is piled on the moisture absorption sheet 4 and the periphery thereof is adhered to the transparent substrate 2 with epoxy resin.

On adhering the moisture-proof sheet 5 to the transparent substrate 2, both are first heated in vacuum up to 200 ° C. or more in order to degas the EL element 1 and to remove the residual moisture as much as possible. Then, both are adhered quickly under the environment of dry nitrogen gas or of dry air.

However, the residual moisture cannot be removed completely in the adhering process, and moisture remains still though the residual amount thereof is little. Further, moisture may penetrate through for example an adhering part when the panel is used for a long time.

The moisture absorption sheet 4 is put in the space 6 in order to absorb such moisture therein.

A moisture absorption sheet 4 is an organic polymer sheet wherein powder of moisture absorbent such as silica fine powder or molecular sieve powder is dispersed. The sheet can have any form such as film, paper, nonwoven fabric or woven fabric.

The moisture absorption sheet 4 is used in such a state inserted between the EL element 1 and the moisture-proof sheet 5 or adhered to the inner surface of the moisture-proof sheet 5.

Moisture which penetrates through the moisture-proof sheet 5 is absorbed by the moisture absorption film 4 so as to make it difficult to reach the thin film EL element 1. Therefore, the reliability against moisture is improved.

Further, the water absorbed by the moisture absorbent in the moisture absorption sheet 4 is also prevented from reaching the thin film EL element 1 by a plastic film 3, so that the reliability against moisture is improved further.

The background of a display panel is preferably black or nearly black on the view point of the contrast of display. Thus, only the moisture absorption sheet 4 or both moisture absorption sheet 4 and moisture-proof sheet 5 is or are colored in dark on the side of the EL element 1.

Thus, when observed from the side of the transparent substrate 2, the background of the display plane becomes dark, so that the contrast becomes better and than the quality of display is improved.

A characteristic of this embodiment is that the moisture absorption sheet 4 and the EL element 1 are adhered planarly. This planar adherence structure enhances further the contrast of display and the look of the thin film EL panel. The planar adherence is kept still when a plastic film 3 is inserted between the sheet 4 and the EL element 1.

Further, the EL element 1 is necessary to be adhered closely to the moisture absorption sheet 4 as to the quality of the display because gaps formed between the EL element 1 and the moisture absorption sheet 4 look like a speckles if any. In the present embodiment, the plastic film 3 may be made of polyethylene, polypropylene, cellophane, polyester, polyvinyl chloride or polyvinylidene chloride which exhibits excellent heat sealing property, moisture-proof property and gas barrier property.

The plastic film 3 can be inserted between the moisture absorption sheet 4 and the EL element 1, or it can be adhered to the moisture absorption sheet 4. The planar adherence can be performed by heating the plastic film 3 of heat-sealing property piled on the moisture absorption sheet 4 to soften and melt the plastic film 3. Thus, the space defined between the EL element 1 and the moisture absorption sheet 4 in the space 6 is filled finally by the heat-sealing plastic film 3, and both plastic film 3 and moisture absorption sheet 4 are adhered closely.

The plastic film 3 of heat sealing property of this embodiment has also an advantage that the reliability for moisture-proof property increases further by preventing water absorbed by the moisture absorbent of the moisture absorption sheet 4 from arriving to the EL element 1 because the plastic film 3 itself has excellent moisture-proof property and gas barrier property.

As explained above, the thin film EL panel of this embodiment can be manufactured at a lower cost and with simpler steps of manufacturing when compared with that of a prior art panel with use of a backup glass. Further, a thin film EL panel can be made thinner and lighter because a backup glass is not used.

Figure 2:
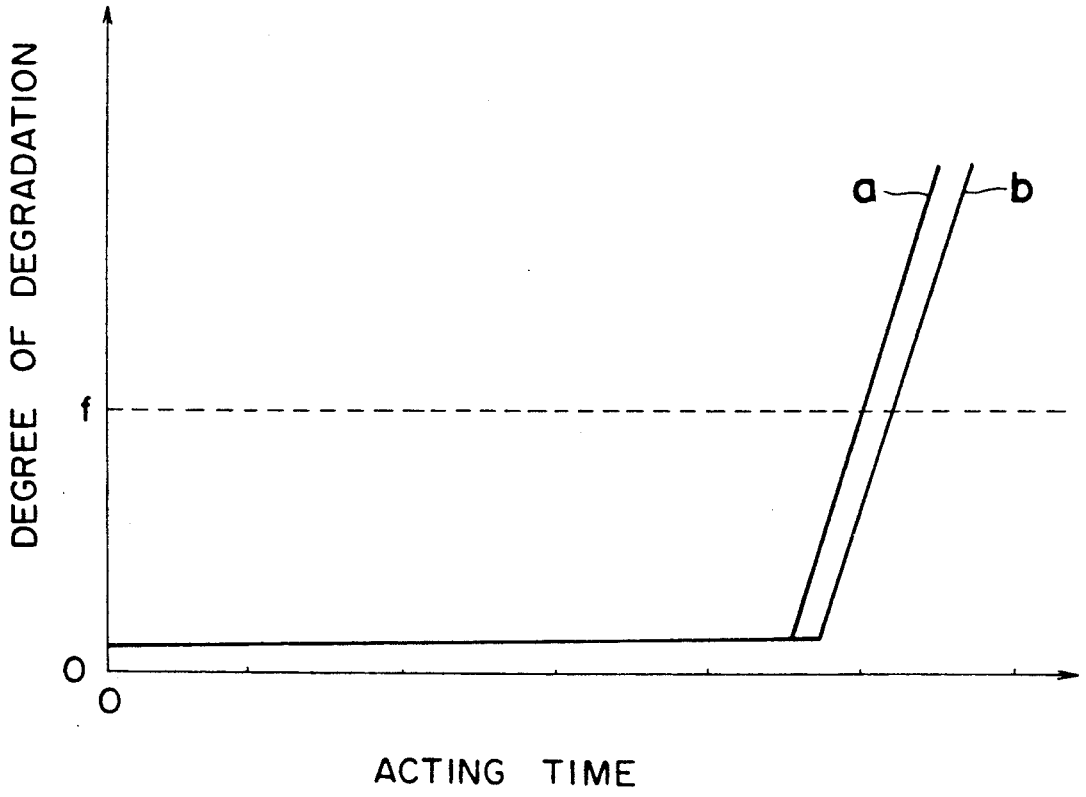
FIG. 2 is a graph of the degree of degradation of an electroluminescent element of the embodiment of FIG. 1 plotted against acting time.

FIG. 2 shows the degree of degradation when a thin film EL panel is operated by applying an electric voltage of 100 Hz to emit light of saturated brightness in the accelerated environment at a high temperature of 85° C. and at a high humidity of 85% RH. A pixcel formed at an intersection of a lower electrode 11 and an upper electrode 15 is decided to degrade if the area which does not emit light becomes wider than a predetermined criterion value. A graduation of the abscissa corresponds to ten thousand hours when converted into practical acting time. In FIG. 2, "a" indicates a case wherein the moisture absorption sheet with dispersed silica powder of plane density of 50 g/cm$^2$ is inserted between the moisture-proof sheet 4 and the EL element 1 while "b" indicates a case wherein the moisture absorption sheet 4 being same as in case of "a" is inserted and further a polypropylene sheet 3 to act as a heat-sealing material at 160° C. is adhered closely between the moisture absorption sheet 4 and the EL element 1. Further, in FIG. 2, "f" indicates a limit where the quality of display begins to degrade by moisture absorption.

It is clearly shown in FIG. 2 that the insertion of the plastic film 3 of heat-sealing property improves the reliability against moisture.

Figure 3:
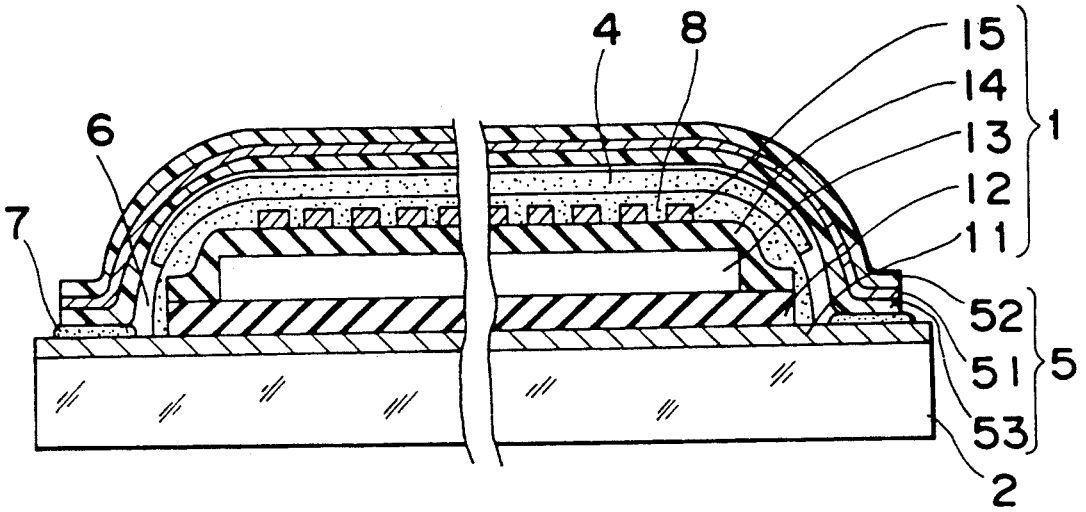
FIG. 3 is a schematic sectional view of another embodiment of this invention.

A thin film EL panel shown in FIG. 3 is similar to that shown in FIG. 1 except the plastic film 3 of heat-sealing property is replaced by silicone resin, silicone compound or silicone grease 8, which is coated on the moisture absorption sheet 4 or the EL element 1 because of its high viscosity. Then, as shown in FIG. 3, the EL element 1 and the moisture absorption sheet 4 are adhered closely to each other easily.

Effects of the silicone resin, silicone compound or silicone grease 8 on the contrast, the look and the reliability of display against moisture is nearly the same as that of the plastic film 3 shown in FIG. 1.

The embodiments explained above are related to panels having EL elements of dot matrix type. However, the EL element 1 can also be an EL element or segment type.

This invention may be practiced or embodied in still other ways without departing from the spirit or essential character thereof. The preferred embodiments described herein are illustrative and not restrictive, the scope of the invention being indicated by the appended claims and all variations which comes within the means of the claims are intended to be embraced therein.

What is claimed is:

1. A thin film electroluminescent panel comprising:

a transparent substrate, a thin film electroluminescent element formed on the transparent substrate, a moisture-proof sheet formed of a metal film located between two resin films, covering the thin film electrolumnescent element, the periphery of the moisture-proof sheet being adhered to the transparent substrate, and a moisture absorption sheet of an organic polymer with dispersed powder of moisture absorbent properties, located on a plastic film, said moisture absorption sheet being located between the thin film electroluminescent element and the moisture-proof sheet, the plastic film being adhered planarly and in direct physical contact with the thin film electroluminescent element.

2. The thin film electroluminescent panel according to claim 1, wherein the plastic film has a heat sealing property.

3. A thin film electroluminescent panel according to claim 2, wherein said plastic film has moisture-proof property.

4. A thin film electroluminescent panel according to claim 2, wherein said plastic film has gas barrier property.

5. A thin film electroluminescent panel according to claim 2, 3 or 4, wherein said plastic film is made of polyethylene, polypropylene, cellophane, polyester, polyvinyl chloride or polyvinylidene chloride.

6. A thin film electroluminescent panel comprising:

a transparent substrate;

a thin film electroluminescent element formed on the transparent substrate;

a moisture-proof sheet formed of a metal film located between two resin films, covering the thin film electroluminescent element, the periphery of the moisture-proof sheet being adhered to the transparent substrate;

a moisture absorption sheet of an organic polymer with dispersed powder of moisture absorbent properties, said moisture absorption sheet being arranged between the thin film electroluminescent element and the moisture-proof sheet being adhered planarly to the thin film electroluminescent element; and means in direct physical contact with said moisture absorption sheet and said thin film electroluminescent element for adhering said electroluminescent element and said moisture-absorption sheet closely in a planar orientation to each other.

7. The thin film electroluminescent panel according to claim 1, 2 or 6, wherein a surface of said moisture absorption sheet is black or almost black on the side of said thin film electroluminescent element.

8. The thin film electroluminescent panel according to claim 7, wherein a surface of said moisture-proof sheet is black or almost black on the side of said thin film electroluminescent element.

9. The thin film electroluminescent panel according to claim 6, wherein said means is a plastic film having a heat sealing property, so that the heat sealing film secures said electroluminescent element and said moisture absorption sheet closely in planar orientation to each other.

10. The thin film electroluminescent panel according to claim 9, wherein said plastic film has a moisture-proof property.

11. The thin film electroluminescent panel according to claim 9, wherein said plastic film has a gap barrier property.

12. The electroluminescent panel according to claim 6, wherein said means is selected from the group consisting of silicone resin, silicone compound or silicone grease.

13. The electroluminescent panel according to claim 1, wherein said electroluminescent panel is free of oil.

14. The thin film electroluminescent panel according to claim 1, wherein the moisture absorption sheet of organic polymer is adjacent to said moisture proof sheet.

15. The thin film electroluminescent panel according to claim 14, wherein said dispersed powder is silica.

16. A thin film electroluminescent panel comprising:

a thin film electroluminescent element formed on and in direct contact with a transparent substrate, a plastic film having a first surface and a second surface, the first surface being adhered to and in direct physical contact with the thin film electroluminescent element, a moisture adsorption sheet of an organic polymer with dispersed powder of moisture absorbent properties, the moisture adsorption sheet located on the second surface of said plastic film, and a moisture-proof sheet formed of a metal film located between two resin films, covering the thin film electroluminescent element, and adjacent said moisture adsorption sheet of organic polymer, the periphery of the moisture-proof sheet being adhered to the transparent substrate.

17. The electroluminescent panel according to claim 16, wherein said dispersed powder is silica.

* * * * *